US012735215B2

(12) United States Patent
Bagnoli et al.

(10) Patent No.: US 12,735,215 B2
(45) Date of Patent: Sep. 15, 2026

(54) VERTICAL PACKAGING MACHINE AND METHOD FOR PACKAGING PRODUCTS

(71) Applicant: ILAPAK ITALIA S.P.A., Foiano della Chiana (IT)

(72) Inventors: Alessandro Bagnoli, Foiano della Chiana (IT); Alessio Primavera, Foiano della Chiana (IT); Giuseppe Romano, Foiano della Chiana (IT)

(73) Assignee: ILAPAK ITALIA S.P.A., Foiano della Chiana (IT)

( * ) Notice: Subject to any disclaimer, the term of this patent is extended or adjusted under 35 U.S.C. 154(b) by 0 days.

(21) Appl. No.: 19/137,984

(22) PCT Filed: Jan. 22, 2024

(86) PCT No.: PCT/IB2024/050576

§ 371 (c)(1),
(2) Date: Jun. 11, 2025

(87) PCT Pub. No.: WO2024/157143

PCT Pub. Date: Aug. 2, 2024

(65) Prior Publication Data

US 2026/0208899 A1 Jul. 23, 2026

(30) Foreign Application Priority Data

Jan. 23, 2023 (IT) ..... 102023000000882

(51) Int. Cl.
*B65B 61/06* (2006.01)
*B65B 9/22* (2006.01)
(Continued)

(52) U.S. Cl.
CPC ..... *B65B 31/045* (2013.01); *B65B 9/22* (2013.01); *B65B 51/30* (2013.01); *B65B 61/06* (2013.01)

(58) Field of Classification Search
USPC ..... 53/433
See application file for complete search history.

(56) References Cited

U.S. PATENT DOCUMENTS 3,482,373 A * 12/1969 Morris ..... B65B 31/045 53/511
6,179,015 B1 1/2001 Kammler et al.
(Continued)

FOREIGN PATENT DOCUMENTS

DE 7229123 U 11/1972

OTHER PUBLICATIONS

PCT International Search Report for corresponding International Application No. PCT/IB2024/050576 mailed Mar. 22, 2024.
(Continued)

*Primary Examiner* — Chinyere J Rushing-Tucker
(74) *Attorney, Agent, or Firm* — Barclay Damon LLP

(57) ABSTRACT

A vertical packaging machine comprising a forming unit comprising an inner tube with an inner cavity and an outer tube surrounding the inner tube said inner and outer tubes defining an annular passage, dispensing means of continuous film, encircling means, longitudinal sealing means, transverse sealing and slitting means, a hopper for products in communication with the inner cavity, a connection cone arranged between said hopper and said forming unit, at least one gas ejector provided on the connection cone and positioned towards the inner tube, at least one gas extraction conduit connected to the annular passage, and a discharge member placed downstream said at least one gas ejector, wherein said discharge member is provided with at least one discharging vent.

15 Claims, 6 Drawing Sheets

(51) Int. Cl.
*B65B 31/04* (2006.01)
*B65B 51/30* (2006.01)

(56) References Cited

U.S. PATENT DOCUMENTS

2012/0266571 A1* 10/2012 Persson ..... B65B 31/045
53/473
2021/0362895 A1* 11/2021 Otxoa-Aizpurua Calvo .....
B65B 61/06

OTHER PUBLICATIONS

Written Opinion of the PCT International Searching Authority for corresponding International Application No. PCT/IB2024/050576 mailed Mar. 22, 2024.

* cited by examiner

Prior Art

VERTICAL PACKAGING MACHINE AND METHOD FOR PACKAGING PRODUCTS

CROSS REFERENCE TO RELATED APPLICATIONS

This application is a U.S. National Stage Application under 35 U.S.C. § 371 of International Application No. PCT/IB2024/050576 filed on Jan. 22, 2024, which claims priority to Italian Application No. 102023000000882 filed on Jan. 23, 2023, both of which are incorporated herein by reference in their entirety.

TECHNICAL FIELD

This invention refers to a vertical packaging machine for packaging products and to a method for packaging products using a vertical packaging machine.

BACKGROUND ART

In the current state of the art, vertical packaging machines comprising a system for feeding packaging material from a reel are known. This packaging material is a film, normally made of plastic, which is fed in continuous or intermittent mode around a vertical forming unit, usually cylindrical, and then sealed to form individually closed packages containing a product.

This type of machine generally comprises a device for advancing the film along a vertical axis of the forming unit, a device configured to move closer longitudinal ends of the continuous film so as to encircle the forming unit, at least one longitudinal sealing means configured to form a continuous packaging tube by sealing the longitudinal ends to each other, a transverse sealing means configured to transversally close the continuous packaging tube filled with the product, and cutting means configured to cut single filled packages, wherein the cutting means may be integrated with the transverse sealing means. The forming unit is configured as a hollow element, with an upper and lower opening to facilitate dispensing of the products to be packaged.

In order to dose the products to be packed, vertical packaging machines also include a hopper above the forming unit into which the product to be fed arrives at the forming unit through the upper opening. Between the hopper and the forming unit, it is possible to arrange an intermediate element configured to control the product dosing into the forming unit. Such product dosing is taken care of by dedicated means, such as pneumatic-type means, which accelerate the product to be fed into the forming unit. In particular, blowing and/or vacuum devices can cause a suction effect and can be mounted in different positions of the packaging machine such as upstream or downstream of the forming unit.

When the product to be packaged is bulky and/or has a low density under atmospheric conditions, for example leafy vegetable products such as salads, vertical packaging machines find it difficult to guarantee high packaging speeds and simultaneously produce small, compact packaging bags, therefore, optimising the flows within the machine is essential to achieve these goals.

Document U.S. Pat. No. 6,179,015-B describes a vertical packaging machine for packaging products, comprising a hopper for inserting product, an intermediate connecting element downstream of the hopper and upstream of a forming unit wherein a gas is blown to accelerate, in a controlled manner, the product arriving from the hopper, wherein the forming unit is made by two concentric cylindrical tubes, one inner and one outer, with a gap between them so as to define two different zones, an inner zone and a surrounding annular zone, separated by the inner cylindrical tube and communicating at the lower part of the forming unit, at the lower opening. A first pneumatic device blows gas in a controlled manner inside the inner tube to accelerate downwardly the product arriving from the hopper. Meanwhile, the annular area communicates with a second pneumatic device that creates a vacuum to extract the gas entering the gap.

With the configuration outlined above, it is necessary that the vacuum created by the second pneumatic device is sufficient to prevent the gas injected by the first pneumatic device swelling the filled packages.

Unfortunately, when using bulky and/or low-density products such as leafy vegetables (e.g.: bagged salad mix), the configuration just presented does not guarantee sufficient suction of all the gas flow fed within the inner tube by the first pneumatic device when operating at high packaging speeds, thus resulting in a limited level of compaction and/or an excess presence of gas within the packaged bag. In addition, this configuration of the known technique does not allow for precise dosage control, resulting for some packages in product trapping in the cross-seal zone, thus compromising the airtightness of the package. The configuration just illustrated also requires large quantities of gas to be fed into the connecting intermediate element. Furthermore, attempting to increase product compaction with this configuration would require a lowering of the packaging speed, thus considerably reducing the productivity of such machine.

SUMMARY OF THE INVENTION

It is therefore necessary to devise a vertical packaging machine and a method thereof that can overcome the drawbacks of the previous technology. To do so, it is necessary to solve the technical problem of creating a vertical packaging machine and a method thereof that is effective, fast and efficient in its operation.

In particular, one aim of the present invention is to realise a vertical packaging machine that minimises the presence of gas inside the packaged bag.

A further aim of the present invention is to realise a vertical packaging machine that achieves high product compaction inside the packaged bag.

Yet another aim of the present invention is to realise a vertical packaging machine capable of saving packaging material in order to offer greater packaging sustainability.

A further aim of the present invention is to realise a vertical packaging machine that guarantees the tightness of the sealed bag even at high packaging speeds.

An additional purpose of this invention is to reduce the gas consumption in the vertical packaging machine.

To overcome the drawbacks of the current state of the art and to achieve these and further purposes and advantages, the applicant has studied, tested and realised the present invention.

The vertical packaging machine of the present invention is expressed and characterised in independent claim 1. Likewise, the method for packaging products in a bag by operating a vertical machine is expressed and characterised by independent claim 14. Dependent claims set out other features of this invention or variants of the main solution.

In accordance with the above-mentioned purposes and in order to solve the aforementioned technical problem in a new and original way, while also gaining considerable advantages over the prior state of the art, a vertical packaging machine for packaging products in a bag comprises:

- a forming unit comprising an inner tube with an inner cavity configured to be crossed by the product to be packaged and a hollow outer tube surrounding the hollow inner tube, said hollow inner and outer tubes being arranged to define an annular passage within the gap between the inner tube and the outer tube, wherein said inner cavity and said annular passage are configured to be put in communication at the bottom of the forming unit during packaging,
- dispensing means configured to dispense a continuous film to the forming unit,
- encircling means configured to face longitudinal ends of the continuous film along the forming unit,
- longitudinal sealing means configured to seal the faced longitudinal ends of the film to form a continuous tube around the hollow outer tube of the forming unit,
- transverse sealing and cutting means configured to transversally seal and cut the continuous film,
- a hopper in communication with the inner cavity of the hollow inner tube,
- a connection cone, arranged between the hopper and the forming unit, configured to receive the product from the hopper, wherein the connection cone has a lateral wall,
- at least one gas ejector provided on the lateral wall of the connection cone,
- at least a gas extraction conduit configured to extract the gas flow entering the annular passage from the bottom of the forming unit, and
- a discharge member provided with at least discharging vent configured and sized to allow the escape of gas.

The forming unit is understood to be a hollow, essentially cylindrical subsystem wherein the dispensed continuous film to be transformed into a packaging tube is firstly laid on its external face by dispensing means cooperating with the encircling means, which faces its longitudinal ends one to each other. Downstream or along the forming unit the continuous film is sealed by longitudinal sealing means. The forming unit is substantially hollow and formed by two concentric tubes, an inner tube and an outer tube, of different diameters, which generate two differentiated zones: an inner cavity and an annular passage within the forming unit, exclusively communicated through the lower opening of the forming unit. While the inner cavity is delimited within the inner tube, the annular zone is delimited by the gap between the inner and outer tube.

The connection cone comprises at least a first body delimiting an antechamber therein, which receives gas from the supply unit. The lateral wall of the connection is internally delimited by an inner frustoconical surface. On the lateral wall there is at least one gas ejector, which has the shape of a duct of reduced cross-section. Such at least one gas ejector has at its end an annular nozzle with an opening on the inner frustoconical surface of the connection cone, allowing the gas flow to be introduced into the connection cone.

Such at least one gas ejector is connected to a gas supply unit. Such supply unit may be an air compressor or a pressurized gas tank containing a gaseous mix. Preferably, the gas supply unit is provided with at least one valve. Such at least one valve is configured and dimensioned to control the flow of gas to be introduced in the connection cone through the at least one gas ejector. Preferably, the valve is of the solenoid valve type and configured to allow for or interrupt the dispense of gas.

The gas flow introduced through the at least one gas ejector is oriented downwards. Preferably, the at least one gas ejector is positioned to eject the gas flow towards the inner tube of the forming unit. Preferably, the at least one gas ejector is configured to introduce a gaseous flow that is substantially tangential to the inner frustoconical surface of the connection cone. Such tangential flow generates a vacuum, causing the overlying product to be pushed downwards instantaneously and immediately in a delivery direction of the product. The connection cone may have a single-stage or two-stage configuration, presenting one or two bodies, each of such bodies comprising an inner frustoconical surface.

In the two-stage configuration each of the two bodies presents a differentiated frustoconical surface. Preferably, such truncated surfaces are superimposed one on top of the other, so that the bottom circular section of the upper frustoconical surface substantially coincides with the upper circular section of the lower frustoconical surface. Preferably, each body is arranged with its respective antechamber, and with at least one gas ejector and annular nozzle, thus being configured to gradually confer the product into the forming unit.

Downstream of the forming unit the excess gas needs to be evacuated. As presented above, the annular passage of the forming unit is used to evacuate such excess gas. The annular passage is connected to the gas extraction conduit. Preferably the gas extraction conduit connects the annular passage with a gas extraction unit of the vertical packaging machine.

Preferably, the gas extraction unit is configured to extract, at least partially, an outbound gas flow equivalent to the ejected gas flow entering the annular passage from the bottom of the forming unit. Such gas flow enters the bottom of the annular passage during the product packaging cycle, i.e., in a manner coordinated with the operation of the at least one gas ejector.

In the preferred embodiment, the gas extraction unit is associated with the upper part of the annular passage of the forming unit. In the preferred embodiment, the extraction unit is configured as a pneumatic suction line.

Preferably, the extraction unit is controlled to allow for or interrupt the extraction of gas.

According to different embodiments, the outbound gas flow extracted from the forming unit is preferably evacuated in the open air, while alternative embodiments envisage the feeding of such gas flow into a dedicated suction and slag recovery ducting line.

According to the preferred embodiment, the vertical packaging machine further comprises the discharge member placed downstream the at least one gas ejector and upstream the inner tube of the forming unit with respect to the delivery direction of the product. The discharge member is configured and dimensioned to allow the passage of the product to be bagged between the connection cone and the inner tube of the forming unit in the downward direction together with the gas ejected towards the inner tube of the forming unit. Preferably, the discharge member has a cylindric shape.

In some embodiments, the outbound gas flow extracted by the extraction unit is displaced in time relative to the gas flow ejected by the ejector in order to optimise the dosing and packaging of the product. This phase shift causes a transient imbalance between the gas flow ejected into the connection cone and the gas flow extracted from the annular passage of the forming unit, leaving a residual quantity of gas inside the forming unit. A part of such residual quantity of gas, if not evacuated, firstly, would end up inside the package together with the product.

Additionally, the remaining part of gas in the forming unit causes a transient overpressure therein with regards to the external environment. Given that typically forming units are not hermetically sealed in its entirety, some of that remaining gas will seek natural evacuation so as to balance pressure with the external environment. The present invention, indeed, directly addresses this technical problem. Preferably, the discharge member is provided with the at least one discharging vent communicating with the external environment.

Preferably the at least one discharging vent is configured and dimensioned to allow the escape of any excess gas remaining in the inner tube and originally proceeding from the at least one gas ejector of the connection cone and introduced into the forming unit and which has not been completely sucked into the annular passage of the forming unit. Indeed, such transient evacuation is done in a quick and simple way.

Therefore, the aim of the proposed vertical packaging machine is to achieve a precise control of the product dosage in the forming unit and consequently in the packaging bag, high compaction of the bagged product and increased energy and resource efficiency, e.g. packaging film material. This is achieved by a highly efficient interaction between the gas supply unit, the gas extraction unit and the at least one discharging vent of the discharge member.

BRIEF DESCRIPTION OF THE DRAWINGS

These and other aspects, features and advantages of the present invention will appear clear from the following description of certain embodiments, provided by way of non-limiting example, with reference to the accompanying drawings wherein.

DETAILED DESCRIPTION OF PREFERRED EMBODIMENTS OF THE INVENTION

It should be noted that in this description the phraseology and terminology used, as well as the figures in the attached drawings also as described, have the sole function of illustrating and better explaining the present invention, having an illustrative function not limiting the invention itself, the scope of protection being defined by the claims.

For ease of understanding, identical reference numbers have been used, where possible, to identify identical common elements in the figures. It should be understood that elements and features of one particular embodiment can be conveniently combined or incorporated into other compatible embodiments without further specification.

Figure 1:
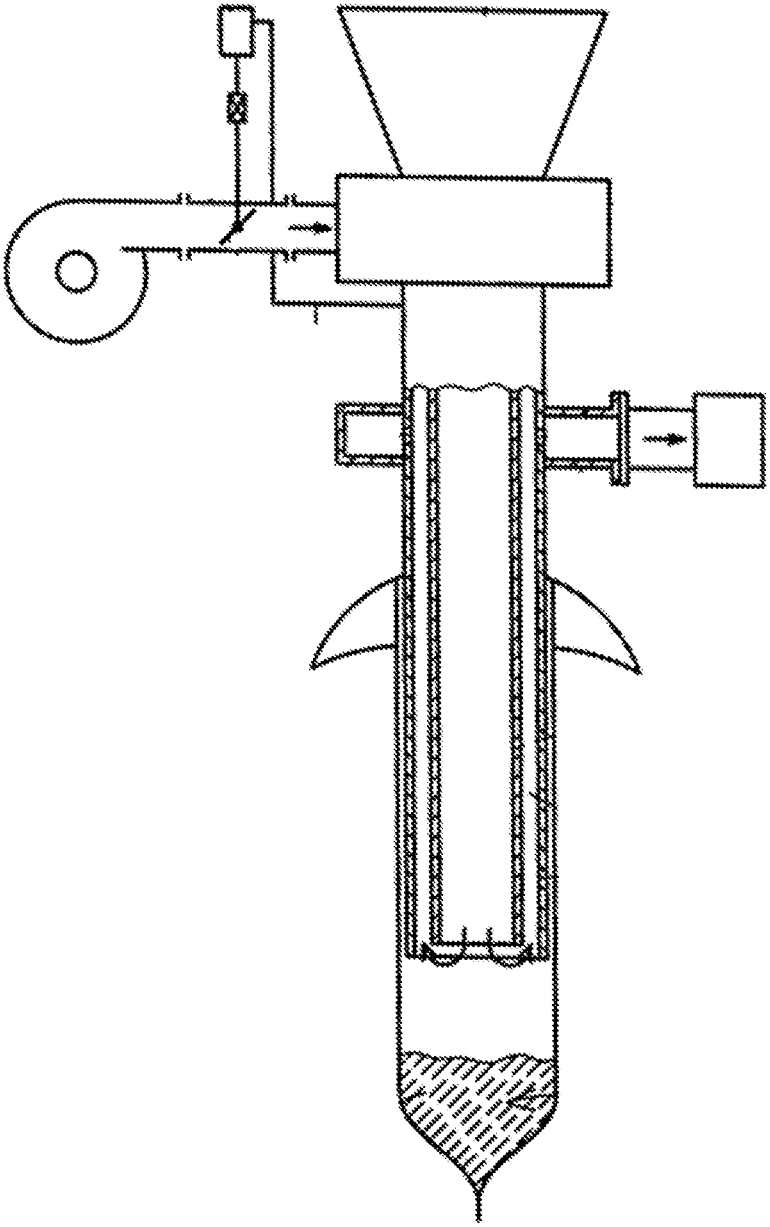
FIG. 1 is a sectional view of a vertical packaging machine according to the prior art with of the present invention.
Figure 2:
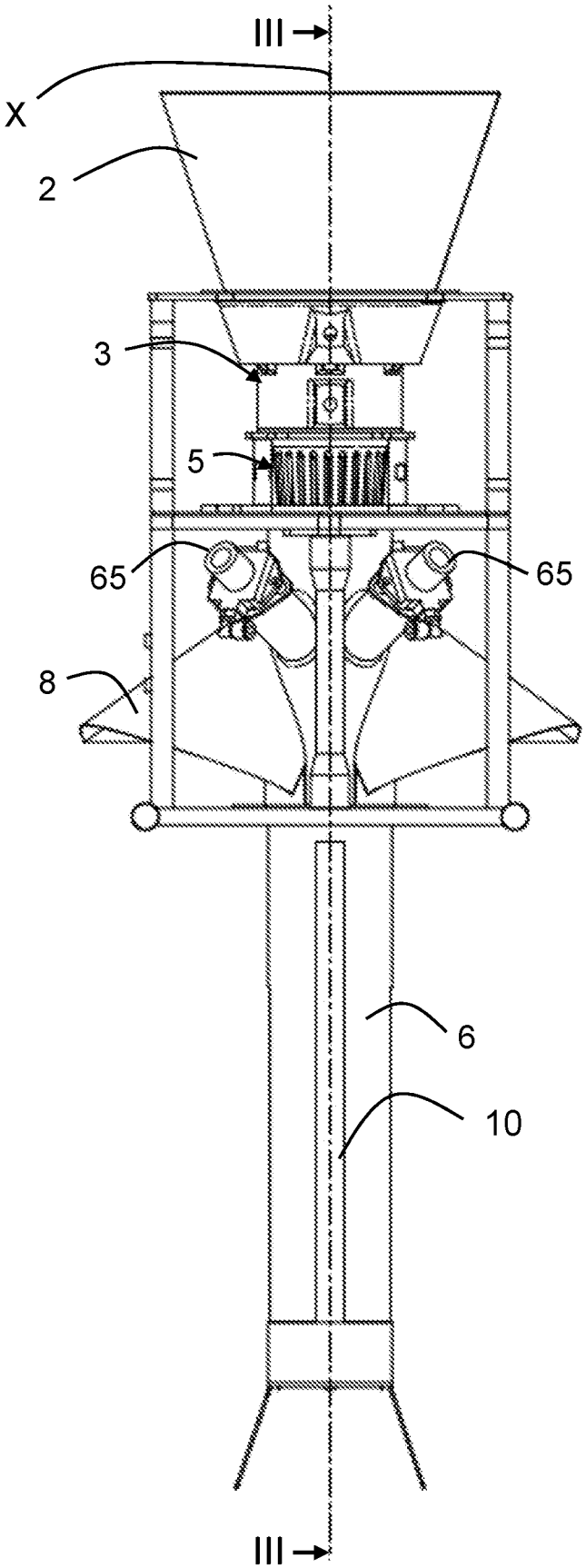
FIG. 2 is a front view of a vertical packaging machine according to the present invention.
Figure 3:
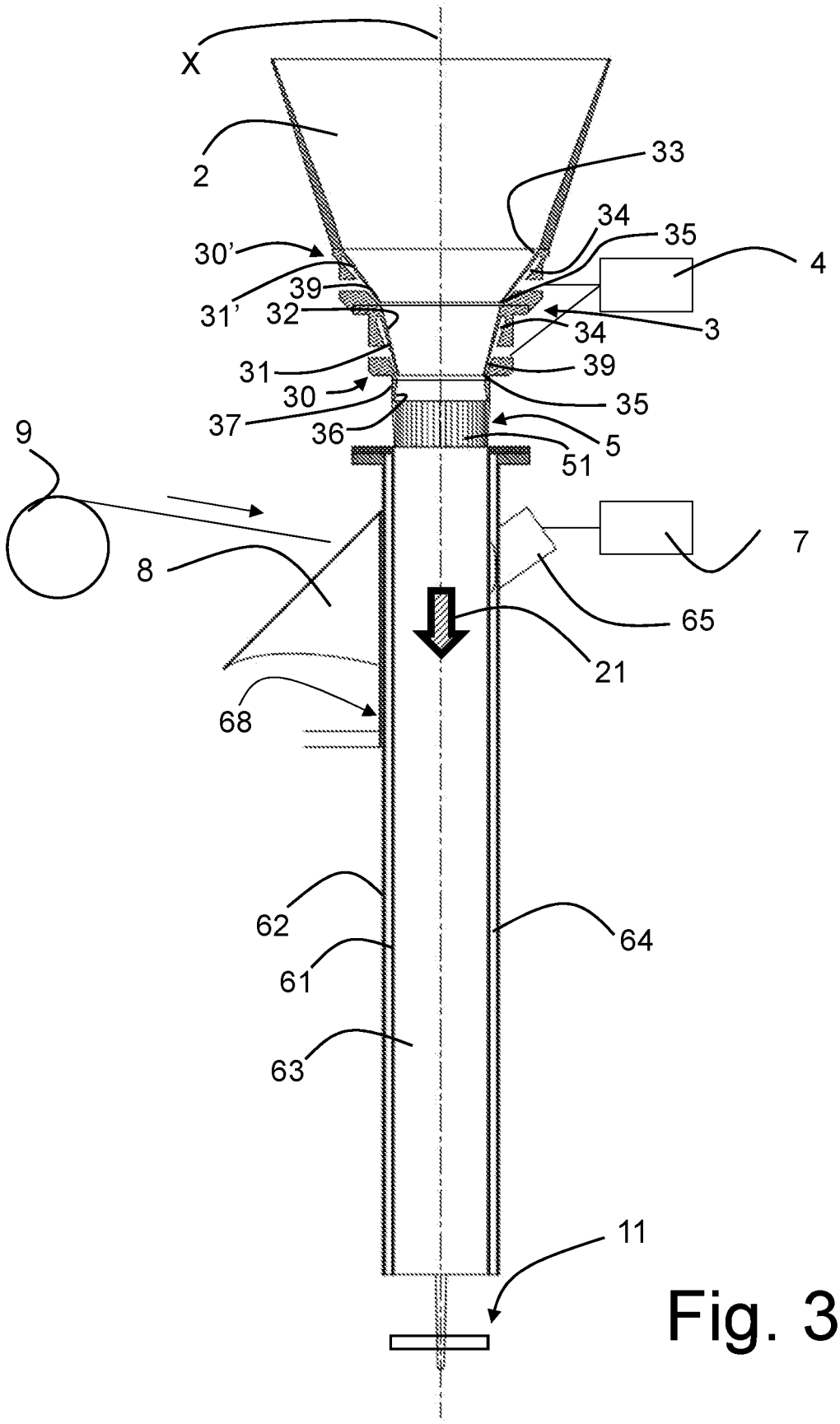
FIG. 3 is a sectional view of a vertical packaging machine according to the present invention.

With reference to FIGS. 2 and 3, the vertical packaging machine 1 comprises a forming unit 6 extending along a vertical longitudinal axis X, and comprising

- a hollow inner tube 61 with an inner cavity 63 configured to be crossed by the product to be packaged, and
- a hollow outer tube 62 surrounding the hollow inner tube 61, said hollow inner 61 and outer 62 tubes being arranged to define an annular passage 64 within a gap between the inner tube 61 and the outer tube 62,
  - wherein said inner cavity 63 and said annular passage 64 are configured to be put in communication at the bottom of the forming unit 6 during packaging,
- dispensing means 9 configured to dispense a continuous film 8 to the forming unit 6,
- encircling means 68 configured to face longitudinal ends of the film 8 along the forming unit 6,
- longitudinal sealing means 10 configured to seal the faced longitudinal ends of the film 8 to form a continuous tube around the hollow outer tube 62 of the forming unit 6,
- transverse sealing and cutting means 11 configured to transversally seal and cut the continuous film 8,
- a hopper 2 in communication with the inner cavity 63 of the hollow inner tube 61,
- a connection cone 3 arranged between said hopper 2 and said forming unit 6 and configured to receive the product from the hopper 2, said connection cone 3 having a lateral wall 31,
- at least one gas ejector 35 provided on said lateral wall 31 of the connection cone 3, said at least one gas ejector 35 being connected to a gas supply unit 4 and positioned to eject a gas flow towards the inner tube 61 of the forming unit 6,
- at least a gas extraction conduit 65 connecting the annular passage 64 with a gas extraction unit 7 configured to extract the gas flow entering the annular passage 64 from the bottom of the forming unit 6, and
- a discharge member 5 placed downstream said at least one gas ejector 35 and upstream the inner tube of the forming unit 6 with respect to a delivery direction 21 of the product, wherein said discharge member 5 is provided with at last one discharging vent 51.

As mentioned above, in its various embodiments, the vertical packaging machine comprises a gas supply unit 4, configured to cyclically feed a gas flow into the connection cone 3, and a gas extraction unit 7, configured to cyclically extract an outbound gas flow from the forming unit 6.

In particular, the product to be packaged in bags is dispensed from above, loading a cargo of such product in the hopper 2. The connection cone 3 below the hopper 2 is configured and dimensioned to suck in doses of the overlying matter, first and foremost the product to be packaged, so as to introduce said dose of product into the inner cavity 63 of the forming unit 6, travelling substantially downwards along the delivery direction 21 across the forming unit 6. The sucking effect is obtained by the ejection of a gas flow by means of the gas supply unit 4 into the connection cone 3, which generates a depression within said cone 3. Said gas supply unit 4 preferably comprises a pneumatic line controlled by a solenoid valve, which performs an activation cycle for each dose of product to be packaged in an individual bag. This solenoid valve may be controlled by a central control unit. The dimensions of the hopper 2 and of the connection cone 3, supported by the corresponding gas supply unit 4, are designed to deliberately clog the connection cone 3 when no gas flow is ejected inside the connection cone 3.

At the same time, according to various embodiments of the present invention, the gas extraction unit 7 is configured to suck by vacuum a gaseous flow from the inside of the forming unit 6, in particular from an annular passage 64, since such a gaseous flow would disturb the downward flow of the product. The gas extracted from the upper part of the annular passage 64 has previously passed through the inner cavity 63 of the forming unit 6 in a downward direction since both zones are communicated in an open lower part of the forming unit 6.

In some embodiments, the gas extraction unit 7 comprises a pneumatic line controlled by an associated solenoid valve, which performs a predetermined opening/closing cycle for each bagged product. The control of the extraction unit 7 is entrusted to a central control unit in communication with the associated solenoid valve. Said pneumatic suction line is connected to the forming unit 6 by the at least one extraction conduit 65 for the extraction of the gas flow. The extraction conduit 65 is mounted on an external surface of the outer tube 62 of the forming unit 6.

According to an embodiment of the present invention, the central control unit is configured to coordinate the activation timing of the gas extraction unit 7 and the gas supply unit 4 in order to optimise the speed of the product packaging. In a particular embodiment, the gas extraction unit 7 and the gas supply unit 4 are operated concurrently.

Preferably, the discharge member 5 is positioned in proximity of a top portion of the hollow inner tube 61 of the forming unit 6. Thus, the discharge element 5 is arranged in communication with the hollow inner tube 61. In other words, the discharge element 5 is mounted adjacent with respect to the inner tube 61, the discharge element 5 being mounted on the top portion of the inner tube 61.

Furthermore, the discharge element 5 is arranged in communication with the connection cone 3. Namely, the discharge element 5 is mounted adjacent with respect to the connection cone 3, wherein the discharge element 5 is mounted immediately underneath the lower part of the connection cone 3.

According to the preferred embodiment, the discharge member 5 is provided with at least one discharging vent 51 configured and dimensioned to allow the escape of a fraction of the ejected gas present in the inner cavity 63 and which is not extracted by the gas extraction unit through the annular passage 64.

The discharging vent 51 of the discharge member 5 allows, in fact, a flow of transient excess gas to be evacuated in the instants wherein the quantity of gas already ejected into the connection cone 3 through the at least one gas ejector 35 is greater than the quantity of gas evacuated through the outer extraction conduit 65, thus allowing such flow of transient excess gas travelling counter-current towards the connection cone 3 to escape through the discharging vent 51.

In a particular embodiment, the at least an outer extraction conduit 65 is located below the at least one discharging vent 51 of the discharge member 5 to optimise the extraction of the outbound gas flow within the annular passage 64 of the vertical packaging machine 1.

The forming unit 6 is configured as a substantially hollow device. In a preferred embodiment, the forming unit comprises two tubes 61, 62 of different diameters and concentric and fixed to each other. In particular, the smaller inner tube 61 delimits the inner cavity 63 while the annular passage 64 is delimited by the gap between the inner tube 61 and the larger diameter outer tube 62 of the forming unit 6.

The lower part of the forming unit 6 is open, allowing communication between the inner cavity 63 and the annular zone 64. Thanks to this communication, the outbound gas flow through the inner cavity 63 of the forming unit 6 coming from above can be sucked from the annular passage 64 by means of the gas extraction unit 7.

Figure 4:
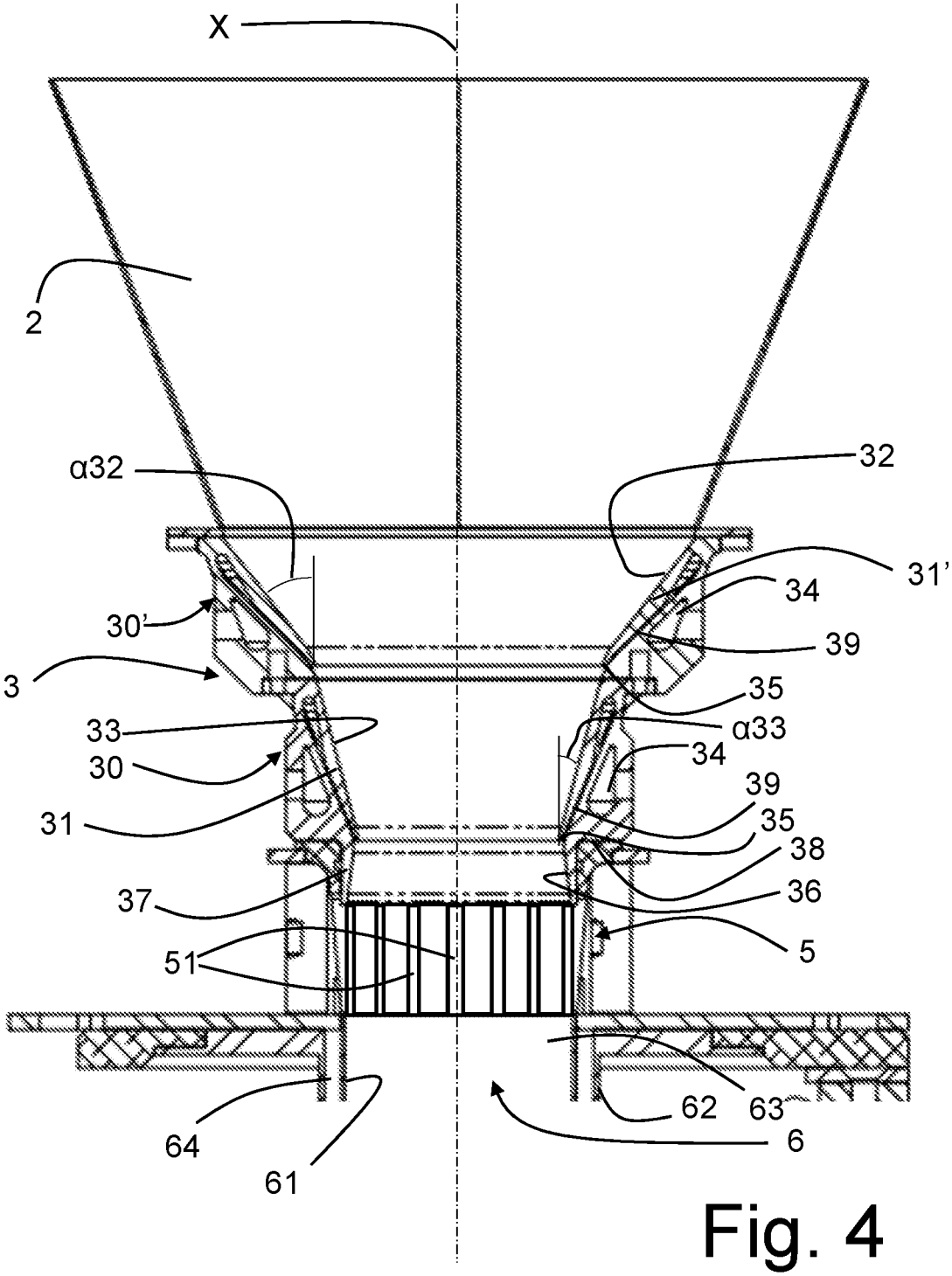
FIG. 4 is a partial sectional detail view of a vertical packaging machine according to the present invention, in particular of the connection cone and its gas inlet means, and of the discharge member.

Referring to FIG. 4, the discharge member 5 allows both the passage of the product to be packed and of the gas flow from the connection cone 3. Preferably, the discharge member 5 has a cylindrical shape with a longitudinal central axis parallel to the vertical longitudinal axis X.

Preferably, the at least one discharging vent 51 consists of a plurality of discharging vents 51 bounded by respective vertical bars spaced apart from each other. Preferably, the plurality of discharging vents is symmetrically distributed around the circular perimeter of the discharge member 5 to optimise the exit of gaseous flow from the discharging vents 51.

According to some embodiments, the discharging vents 51 are positioned near or in contact with the top of the inner tube 61 of the forming unit 6 to facilitate the extraction of an outward transient excess gas flow.

The upper part of the inner tube 61 of the forming unit 6 is mounted beneath the lower part of the discharge member 5. This configuration allows the forming unit to receive the flow passing through the discharge member 5 only inside the inner cavity 63 of the moulding element 6. In this sense, the vertical moulding machine 1 is configured and dimensioned to provide air-tightness between said discharge member 5 and said inner tube 61 of the moulding element 6. Air-tightness between the discharge member 5 and the inner tube 61 can be provided, for example, by means of the interposition of an intermediate gasket.

Preferably, each of the open vent discharging vents 51 of the discharge member 5 substantially has a rectangular shape. According to some embodiments, the rectangular shape will imply having two parallel sides that are longer than the other two corresponding perpendicular sides. Preferably, the height of each of the open vent discharging vents 51 is greater than its respective base. In particular, the height-to-length ratio is preferably of at least 3:1.

Preferably, the connection cone 3 comprises at least a first body 30 having a first internal surface 32 of frustoconical shape on said lateral wall 31. The first internal surface 32 presents an upward opening, i.e. funnel-shaped with the larger diameter section above the smaller diameter section. This first body is used in single-stage configuration, which is used in applications where gradual dosing of the product is not required to ensure the quality of the packaging process.

In an alternative embodiment, the present invention provides a two-stage configuration, wherein the connection cone 3 further comprises a second body 30' having a second inner frustoconical surface 33, having a lateral wall 31' with an upward opening. According to this embodiment, the second body 30' is adjacent and placed on top of the first body 30, wherein the product to be packaged firstly crosses the second body 30' before crossing the first body 30 along the delivery direction. According to this embodiment, the upper opening of the surface 32 of the first body 30 corresponds with the lower opening of the surface 33 of the second body so as to ensure continuity between the inner frustoconical surfaces 32 and 33 of the connection cone 3.

Furthermore, in the two-stage configuration, the first body 30 has a different opening angle with respect to the opening angle of the second body 30'. In other words, the frustoconical surface 32 of the first body 30 has an upward opening smaller than that of the frustoconical surface 33 of the second body 30' above. In particular, the opening angle $\alpha$32 of the frustoconical surface 32 of the first body 30 with respect to the vertical direction is smaller than the opening angle $\alpha$33 of the frustoconical surface 33 of the second body 30'. This type of dimensioning facilitates the gradual dosing of the product to be conveyed into the forming unit 6.

With regards to the dimensions of the connection cone 3, the single-stage configuration is dimensioned in such a way that the height of the single body 30 will be smaller than the sum of the heights of the first body 30 and second body 30' of the two-stage solution, the height of the single body 30 of the single-stage solution being in any case larger than the heights of the individual first body 30 and second body 30' of the two-stage solution.

In any one of the embodiments of the present invention, each of the bodies 30, 30' of the connection cone 3 has within the respective lateral wall 31, 31' at least one antechamber 34 configured to receive the gas flow injected by the gas supply unit 4. The gas supply unit 4 and the at least one antechamber 34 communicate with each other. The flow gas received in the antechamber 34 is then introduced into the innermost part of the connection cone 3, i.e. the area delimited by the inner frustoconical surface 32, 33, thanks to a conduit 39 excavated along the lateral wall 31, 31' and communicating the antechamber 34 and the frustoconical surface 32, 33. In particular, the gas is introduced into the innermost area of the connection cone 3 by the at least one gas ejector 35.

Preferably, the at least one ejector 35 is positioned at least in the lower part of the connection cone 3, thus closer to the hollow inner tube 61. Preferably, the ejector 35 is configured as an opening made in the lower part of the frustoconical surfaces 32, 33 and connected to the conduit 39. Such opening is arranged along a horizontal circular perimeter of the frustoconical surface 32, 33.

According to a preferred embodiment, the at least one gas ejector 35 may be configured and sized as an annular nozzle or annular hole or a plurality of circular nozzles or holes distributed along an arc of horizontal circumference on the lateral wall 31, 31' of connection cone 3. In other embodiments, such at least one gas ejector 35 may be configured as a horizontal slit on the lateral wall 31, 31' of the connection cone 3. In particular, some embodiments provide a single continuous horizontal slit along the entire perimeter, while others provide a slit interrupted along the circular perimeter. According to yet another embodiment, the gas ejector 35 is configured and dimensioned as a at least one groove of oblong shape along circumference of the lateral wall 31, 31' of the connection cone 3.

The antechamber 34 and the at least one gas ejector 35 of the present invention are configured and sized to cause a Venturi effect of acceleration of the gas flow between the antechamber 34 and the at least one gas ejector 35, taking advantage of the fact that the total cross-sectional area of the at least one gas ejector 35 is considerably smaller than that of the antechamber 34 of the connection cone 3.

The at least one gas ejector 35 is configured to direct the gas flow tangentially with respect to the inner frustoconical surface 32, 33 of the respective body 30, 30' of the connection cone 3. This configuration results in a flow tangential to the frustoconical surface 32 which, due to the Coandă effect, generates a depression resulting in the suction of the overlying product present in the connection cone 3.

Depending on the product to be packaged, some forms of implementation involve special chemical compositions of the gas fed into the connection cone 3. For example, in the case of dosing of products of short lifespan, the present invention is compatible with dosing of inert gas mixtures such as the so-called Modified Atmosphere Packaging (MAP) processes into at least one of the frustoconical surfaces 32, 33.

According to some embodiments of the present invention, the connection cone 3 comprises an additional frustoconical surface 36 positioned below the internal frustoconical surface 32, with a bigger opening of the additional frustoconical surface 36, and closer to the discharge member 5. In other words, the additional frustoconical surface 36 has a downward opening, i.e. funnel-shaped with the larger diameter section below the smaller diameter section. The additional frustoconical surface 36 is configured and sized to optimise the vertical downward flow from the connection cone 3 towards the forming unit, and to facilitate the vertical upward, counter-current transient flow from the forming unit to exit the discharge vents 51 of the discharge member 5.

Preferably, the additional frustoconical surface 36 rests on the upper surface of the discharge element 5, allowing the gas flow ejected by gas ejector 35 to be directed into the hollow inner tube 61 of the forming unit 6. In an embodiment of particular interest, the diameter of the lower section of the additional frustoconical surface 36 corresponds to the internal diameter of the discharge member 5, Wherein the lower end portion of the connection cone 3 containing the additional frustoconical surface 36 is configured as a cylindrical protrusion 37. Preferably, the cylindrical protrusion 37 is dimensioned to rest on top of the upper portion of the discharge member 5 so as to ensure air-tightness between said connection cone 3 and the exhaust element 5.

Figure 5A:
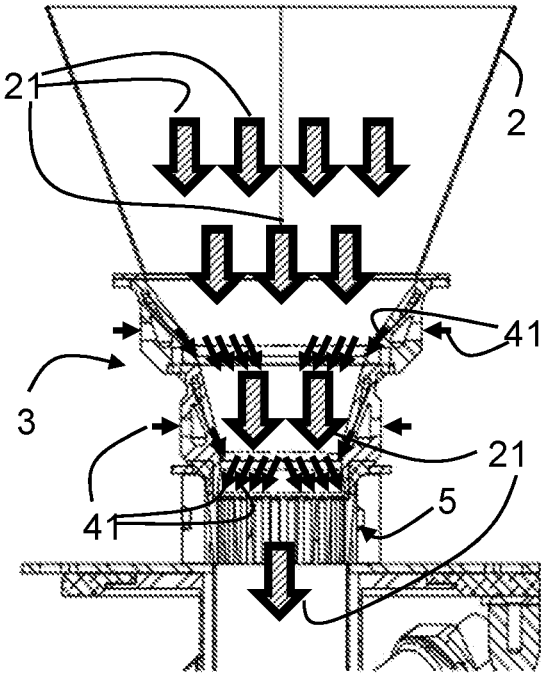
FIGS. 5A, 5B, 5C, 5D show, respectively, a cross-sectional view of the packaging machine's flows during the feeding step, a detailed cross-sectional view of the flows during gas ejecting and product feeding steps, a detailed cross-sectional view of a gas discharging step, and of a gas extraction step.
Figure 5B:
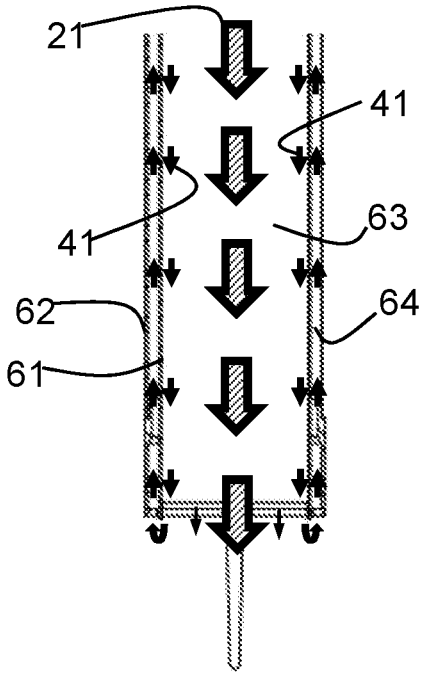

With reference to FIGS. 5A, 5B, 5C and 5D, and reiterating concepts shown above, the flows of product and gas ejected into and extracted from the vertical packaging machine 1 are illustrated in detail. FIG. 5A shows how, during the feeding step of the packaging cycle, the gas flow supplied into the innermost zone of the connection cone 3 through the at least one gas ejector 35 in the lower zone of the frustoconical surfaces 32, 33, results in an ejected gas flow 41 substantially tangential to said frustoconical surfaces 32, 33. Said ejected gas flow 41 generates, by the Coandă effect, a depression causing the suction of a dose of overlying product proceeding from the hopper 2 along the delivery direction 21. Moreover, since the product to be dosed can be of the granular type or the foil-type, typically air is present among the product that is fed. As shown in FIG. 5B, the sum of both flows travels in a downward direction along the inner cavity 63 of the forming unit 6 up to its lower end. In order to minimise the gaseous content within the package, the gas extraction unit 7 sucks an outbound gas flow which, under ideal conditions substantially equals the ejected flow 41 provided through the gas ejector 35. Such outbound gas flow is evacuated through the annular passage 64 of the forming unit 6. The difference between the ejected gas flow 41 and the outbound gas flow, which is ideally negligible, may be added to the contents of the dose of overlying product travelling in the delivery direction 21 to the packing tube, comprising the product to be dosed, which will end up inside the package in the dosing step of the packaging process.

Figure 5C:
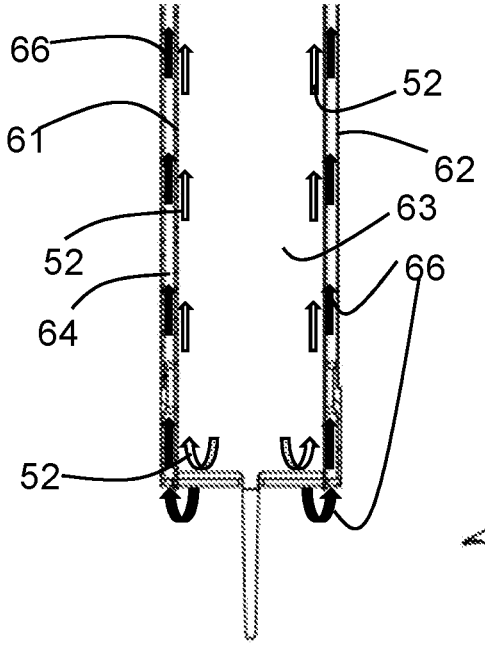
Figure 5D:
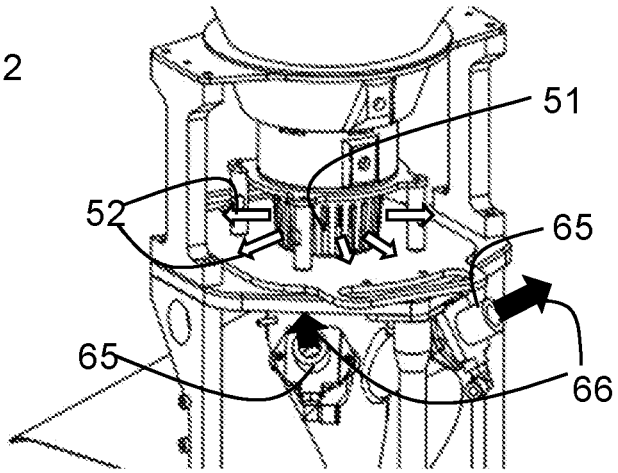

With reference to FIGS. 5C and 5D, during a transient step of the packaging process, in particular between two consecutive dosages of product, the momentary stop of the gas supply unit 4 and the gas extraction unit 7 causes a momentary counter-current flow 52 in the inner cavity 63 of the forming unit 6. During two consecutive dosages of product, gaseous content is both present in the inner cavity 63 and in the annular passage 64 of the forming unit 6.

Indeed, the momentary counter-current flow 52 can coexist with the already existing outbound gas flow 66 which continues, due to the inertia acquired during the previous suction caused by the gas extraction unit 7, while it was operating, in order to cross the annular passage 64 of the forming unit 6 in an upward direction. The momentary counter-current flow 52 has an upward direction, so that part of the gas contained in the inner cavity 63 of the forming unit tends to spontaneously propagate upwards seeking the easiest way to escape. With reference to FIG. 5D, it is shown that the momentary counter-current flow 52 is evacuated into free air, while the existing outbound gas flow 66 is evacuated from the forming unit 6 by the at least one evacuation tube 65.

Figure 6:
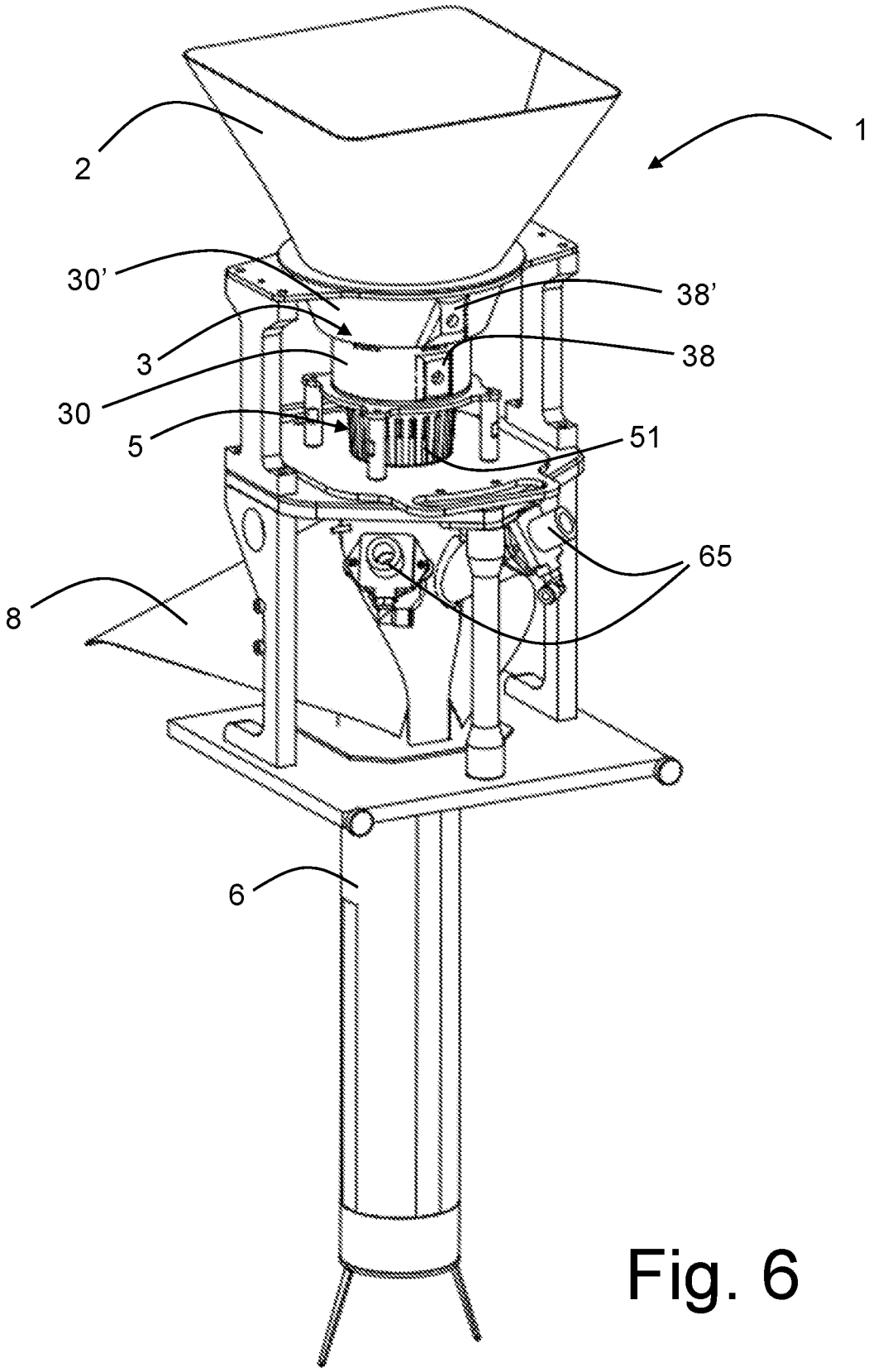
FIG. 6 is a general three-dimensional view of a vertical packaging machine of the present invention.

With reference to FIG. 6, in certain embodiments of the invention the inlet means 4 can be connected to inlet pipes 38, 38' for the inlet of gas into the connection cone 3. Such differentiated inlet pipes 38, 38' allow to separate inlet into the innermost zones of the bodies 30, 30' delimited by respective inner frustoconical surfaces 32, 33 of the connection cone 3 (shown in FIGS. 3 and 4). Accordingly, the differentiated inlet allows for varying the flow rate and physical conditions of the gas in each inner frustoconical surface 32, 33, such as temperature and/or, pressure, and/or the chemical composition of the gas. Of course, alternatively, the inlet means may feed gases of the same chemical composition and physical conditions into the inlet tubes 38, 38'.

Preferably, the outbound gas flow extracted through the extraction conduit 65 by means of the gas extraction unit 7 (schematically represented in FIG. 3), will be evacuated in free air. Alternatively, the gas extraction unit 7 may convey the outbound gas flow into a dedicated ducting line for its suction and slag recovery.

The present invention further extends its scope to a method for the packaging of products by operating a vertical packaging machine according to any of the different embodiments already illustrated.

The method for the packaging of products includes the steps of:

providing a forming unit 6 extending along a vertical longitudinal axis X, and comprising a hollow inner tube 61 with an inner cavity 63 configured to be crossed by the product to be packaged and a hollow outer tube 62 surrounding the hollow inner tube 61, said hollow inner 61 and outer 62 tubes being arranged to define an annular passage 64 within a gap between the inner tube 61 and the outer tube 62, said inner cavity 63 and said annular passage 64 being configured to be put in communication at the bottom of the forming unit 6 during packaging;

dispensing a film 8 to the forming unit 6, facing longitudinal ends of the film 8 along the forming unit 6;

longitudinally sealing the faced longitudinal ends of the film 8 to form a continuous tube around the hollow outer tube 62 of the forming unit 6, transversally sealing and cutting the continuous film 8, feeding a product into said hollow inner tube 61 from a hopper 2 passing through a connection cone 3 arranged between said hopper 2 and said forming unit 6, ejecting a gas flow 41 towards the inner tube 61 of the forming unit 6 from at least one gas ejector 35 provided on a lateral wall 31 of the connection cone 3, and extracting the gas flow entering the annular passage 64 from the bottom of the forming unit 6 from at least one gas extraction conduit 65.

The method further comprises the following step:

allowing a fraction 52 of the ejected gas 41 present in the inner cavity 63 and which is not extracted by the gas extraction unit 7 through the annular passage 64 to escape the hollow inner tube 61 through at least one discharging vent 51 of a discharge member 5 arranged in communication with the hollow inner tube 61, said discharge member 5 being placed downstream said at least one gas ejector 35 and upstream the inner tube 61 of the forming unit 6 with respect to a delivery direction 21 of the product.

Preferably, the method implies that, at least during the extracting step, the at least one discharging vent 51 is kept open. While being open, the at least one discharging vent 51 typically puts the hollow inner tube 61 in communication with the external environment. The method may be applied to a vertical packaging machine wherein the discharge member 5 comprises a plurality of open discharging vents 51 that allow the venting of the momentary counter-current flow 52 when no gas ejection and/or extraction takes place.

The invention claimed is:

1. A vertical packaging machine for packaging products in a bag, said machine comprising:

a forming unit extending along a vertical longitudinal axis, and comprising a hollow inner tube with an inner cavity configured to be crossed by a product to be packaged and a hollow outer tube surrounding the hollow inner tube, said hollow inner and outer tubes being arranged to define an annular passage within a gap between the inner tube and the outer tube, said inner cavity and said annular passage being configured to be put in communication at a bottom of the forming unit during packaging;

dispensing means configured to dispense a film to the forming unit;

encircling means configured to face longitudinal ends of the film along the forming unit;

longitudinal sealing means configured to seal the faced longitudinal ends of the film to form a continuous tube around the hollow outer tube of the forming unit;

transversal sealing and cutting means configured to transversally seal and cut the continuous film;

a hopper in communication with inner cavity of the hollow inner tube;

a connection cone arranged between said hopper and said forming unit and configured to receive the product from the hopper, said connection cone having a lateral wall;

at least one gas ejector provided on said lateral wall of the connection cone, said at least one gas ejector being connected to a gas supply unit and positioned to eject a gas flow towards the inner tube of the forming unit and;

at least one gas extraction conduit connecting the annular passage with a gas extraction unit configured to extract the gas flow entering the annular passage from the bottom of the forming unit a discharge member placed downstream said at least one gas ejector and upstream the inner tube of the forming unit with respect to a delivery direction of the product, wherein said discharge member is provided with at least one discharging vent, said discharge member being arranged in communication with the hollow inner tube and being configured to allow a fraction of the ejected gas flow present in the inner cavity and which is not extracted by the gas extraction unit through the annular passage to escape the hollow inner tube through the at least one discharging vent.

2. A vertical packaging machine according to claim 1, wherein said discharge member is positioned in proximity of a top portion of the hollow inner tube of the forming unit.

3. A vertical packaging machine according to claim 1, wherein said discharge member has a cylindrical shape with a longitudinal central axis parallel to the vertical longitudinal axis (X).

4. A vertical packaging machine according to claim 1, wherein said at least one discharging vent consists of a plurality of discharging vents bounded by respective vertical bars spaced apart from each other.

5. A vertical packaging machine according to claim 1, wherein each of said discharging vents of the discharge member substantially have a substantially rectangular shape with a height-to-length ratio of at least 3:1.

6. A vertical packaging machine according to claim 1, wherein said at least one gas ejector is positioned at a lower part of the connection cone closer to the hollow inner tube.

7. A vertical packaging machine according to claim 1, wherein said at least one gas ejector has a configuration selected from the group consisting of a horizontal slit on the lateral wall of the connection cone, a plurality of holes distributed along an arc of horizontal circumference on the lateral wall of connection cone, or at least one groove of oblong shape along a circumference on the lateral wall of connection cone.

8. A vertical packaging machine according to claim 1, wherein the connection cone comprises at least a first body having a first internal surface of frusto-conical shape on said lateral wall.

9. A vertical packaging machine according to claim 8, wherein said connection cone comprises an additional frustoconical surface positioned below the internal frustoconical surface, with a bigger opening of said additional frustoconical surface closer to the discharge member.

10. A vertical packaging machine according to claim 9, wherein said additional surface rests on an upper surface of the discharge element allowing the gas flow ejected by gas ejector to be directed into the hollow inner tube of the forming unit.

11. A vertical packaging machine according to claim 8, wherein the connection cone further comprises a second body having a second internal frustoconical surface, said second body being adjacent to and placed on top of the first body, wherein the product to be packaged firstly crosses the second body before crossing the first body along the delivery direction.

12. A vertical packaging machine according to claim 11, wherein the first body has a different opening angle with respect to an opening angle of the second body.

13. A vertical packaging machine according to claim 8, wherein said at least one gas ejector is configured to direct the gas flow tangentially with respect to said first internal frustoconical surface of the first body.

14. A method for packaging products in a bag by operating a vertical packaging machine, said method comprising the steps of:

providing a forming unit extending along a vertical longitudinal axis, and comprising a hollow inner tube with an inner cavity configured to be crossed by a product to be packaged and a hollow outer tube surrounding the hollow inner tube, said hollow inner and outer tubes being arranged to define an annular passage within a gap between the inner tube and the outer tube, said inner cavity and said annular passage being configured to be put in communication at a bottom of the forming unit during packaging;

dispensing a film to the forming unit;

facing longitudinal ends of the film along the forming unit;

longitudinally sealing the faced longitudinal ends of the film to form a continuous tube around the hollow outer tube of the forming unit;

transversally sealing and cutting the continuous film;

feeding a product into said hollow inner tube from a hopper passing through a connection cone arranged between said hopper and said forming unit;

ejecting a gas flow towards the inner tube of the forming unit from at least one gas ejector provided on a lateral wall of the connection cone and;

extracting the gas flow entering the annular passage from the bottom of the forming unit from at least one gas extraction conduit and allowing a fraction of the ejected gas present in the inner cavity and which is not extracted by the gas extraction unit through the annular passage to escape the hollow inner tube through at least one discharging vent of a discharge member arranged in communication with the hollow inner tube, said discharge member being placed downstream said at least one gas ejector and upstream the inner tube of the forming unit with respect to a delivery direction of the product.

15. The method according to claim 14, wherein the at least one discharging vent is kept open at least during the extracting step.

* * * * *